US005316807A

United States Patent [19]

Hill

[11] Patent Number: 5,316,807

[45] Date of Patent: May 31, 1994

[54] ARTIFICIAL FROND FOR USE WITH ARTIFICIAL PLANTS

[75] Inventor: Steven L. Hill, Tucson, Ariz.

[73] Assignee: The Larson Company, Tucson, Ariz.

[21] Appl. No.: 947,104

[22] Filed: Sep. 18, 1992

[51] Int. Cl.[5] ..... A41G 1/00

[52] U.S. Cl. ..... 428/17; 428/21

[58] Field of Search ..... 428/17, 18, 21; 156/61; 362/122, 123; D11/117, 118

[56] References Cited

U.S. PATENT DOCUMENTS

| | | | |
|---|---|---|---|
| 2,716,828 | 9/1955 | Adler, Jr. | 428/17 |
| 3,578,105 | 5/1971 | Griff | 428/21 X |
| 4,727,672 | 3/1988 | Hill et al. | 428/17 X |
| 5,171,615 | 12/1992 | Cohen et al. | 428/18 |

*Primary Examiner*—Henry F. Epstein
*Attorney, Agent, or Firm*—Ogram & Teplitz

[57] ABSTRACT

An artificial frond for use with artificial plants comprises an integral sheet of flexible polymeric material molded generally in the shape of a frond having a central elongate stem portion and a plurality of elongate leaves extending outwardly from the stem portion. Reinforcing means sufficient to maintain the structural integrity of the artificial frond, including structural supporting rods and elasticity-imparting fiber material, are embedded within the integral sheet. The integral sheet is preferably a laminate having a flexible polymeric foam intermediate body layer and outer surface layers pigmented to simulate the color of a natural frond.

28 Claims, 1 Drawing Sheet

ARTIFICIAL FROND FOR USE WITH ARTIFICIAL PLANTS

BACKGROUND OF THE INVENTION

This invention relates to an artificial frond for use with artificial plants, and more particularly, to an artificial palm frond for use with artificial palm trees.

Artificial palm trees are customarily employed both indoors for creating a tropical effect, and outdoors for ornamenting lawns, boulevards, parkways, park grounds, and the like. In constructing such artificial trees, the artificial fronds are typically individually fabricated and then appropriately anchored to the trunk portion of the tree. The fabrication of artificial palm fronds in the size and shape duplicating the appearance of their natural counterparts and with the structural integrity sufficient to withstand the natural forces encountered in outdoor use, has generally been an arduous and time-consuming task.

Previous techniques for fabricating artificial fronds have generally relied upon adhesive or mechanical attachment of the leaf portions of the frond to a supporting rod or stem member. This has usually required each individual leaf to be separately formed and separately secured at its lower end to the stem member. Reduction in the number of individual parts required for assembly has previously been achieved by cutting a flexible sheet of fabric or the like along approximately parallel lines which extend a substantial part of the distance across the sheet so as to define a large number of petal or leaf portions integral at one end with a connecting strip. The connecting strip is then wrapped about a stem member of wire or the like and secured thereto by a malleable wire wrapping so that the petal or leaf portions are arrayed about and extend from the supporting stem member.

While artificial palm fronds have previously been constructed by techniques similar to those described above, such palm fronds have generally been limited to the type whose leaves extend outwardly from the stem portion in a feather-like arrangement. When attempting to fabricate artificial palm fronds of the type whose leaves extend outwardly from the stem portion in a fan-like arrangement, maintaining the structural integrity of the frond, particularly for outdoor use, becomes much more serious of a problem. The areas of particular concern are in providing sufficient structural support for the more concentrated mass at the inner region of the fan-like leaf arrangement, and in providing sufficient elasticity and tear resistance for the thinner sectioned outer region thereof.

The present invention overcomes many of the disadvantages of the artificial frond fabrication techniques described above by providing an artificial frond construction capable of being easily molded in one piece with sufficient structural integrity to accommodate the requirements of artificial palm fronds with a fan-like type of leaf arrangement.

SUMMARY OF THE INVENTION

The present invention provides an artificial frond construction for use with artificial plants, wherein the artificial frond comprises an integral sheet of flexible polymeric material molded or otherwise formed generally in the shape of a frond having a central elongate stem portion and a plurality of elongate leaves extending outwardly from the stem portion. Reinforcing means sufficient to maintain the structural integrity of the artificial frond, such as one or more elongate supporting rods providing structural support for the frond and an elasticity-imparting fiber material, are embedded within the integral sheet. The integral sheet is preferably a laminate having outer surface layers pigmented to simulate the color of a natural frond.

The artificial frond construction of the present invention is easily molded in one piece with sufficient structural integrity to be particularly suitable for the fabrication of artificial palm fronds with a fan-like type of leaf arrangement.

The invention will be more fully described in its preferred embodiment by the following detailed description considered in conjunction with the accompanying drawings.

DESCRIPTION OF THE PREFERRED EMBODIMENT

Figure 1:
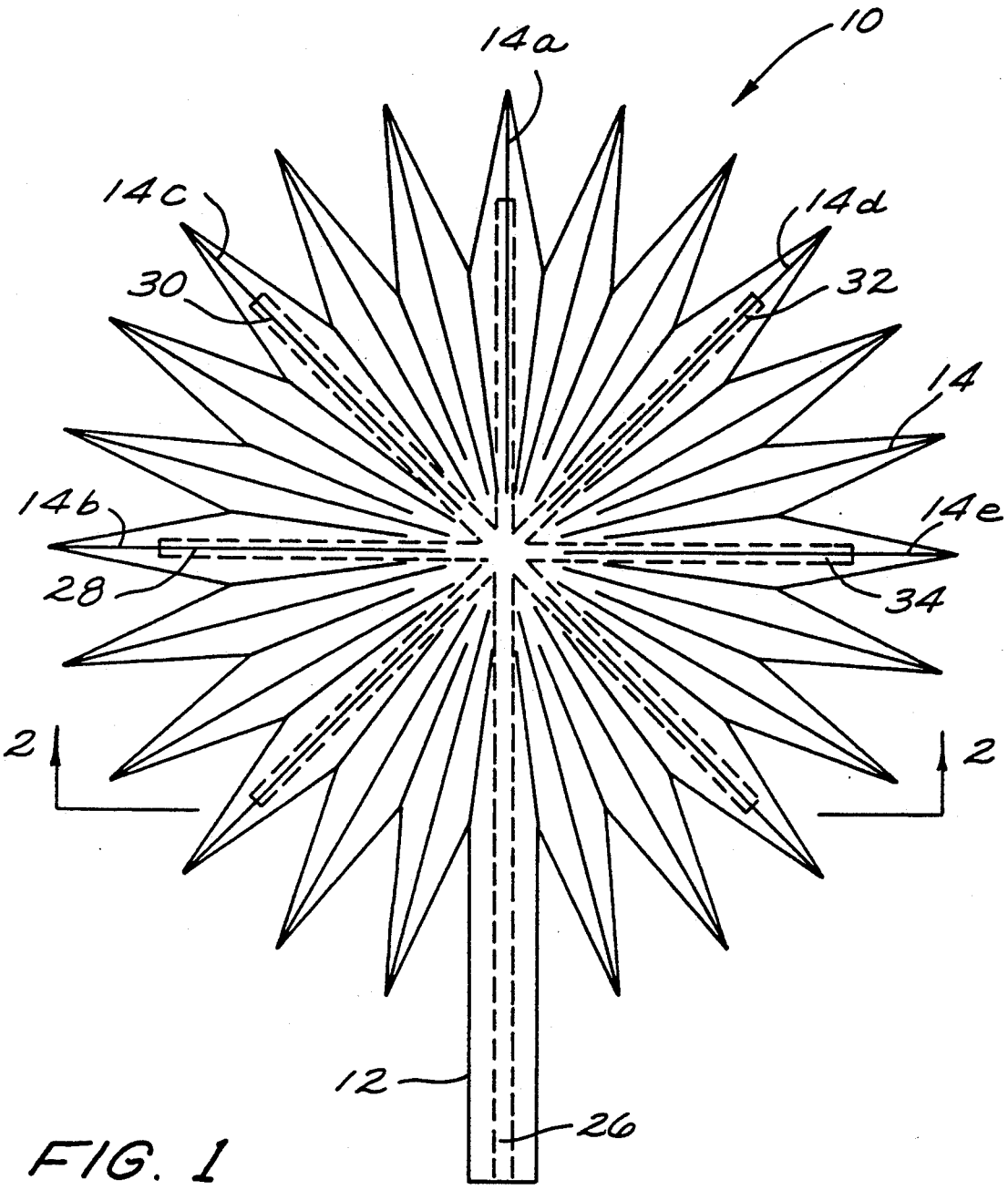
FIG. 1 is a top plan view of an artificial frond in accordance with the present invention.
Figure 2:
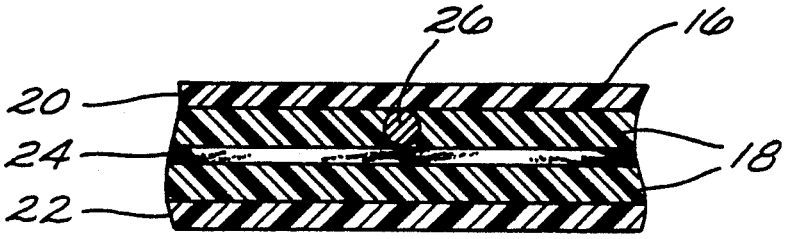
FIG. 2 is a greatly enlarged partial cross-sectional view of the artificial frond of FIG. 1 taken along lines 2—2 of FIG. 1.

Referring to the drawings in detail, wherein like numerals indicate like elements throughout, there is shown in FIGS. 1 and 2 a preferred embodiment of an artificial frond 10 in accordance with the present invention. In the present embodiment, it is preferred that the artificial frond 10 be an artificial palm frond with a fan-like type of leaf arrangement for use with artificial palm trees (not shown). However, it is understood by those skilled in the art that the present invention is not limited to any particular type of frond or plant therefor, and that it is equally applicable to artificial palm fronds with a feather-like type of leaf arrangement (not shown), and to other artificial fronds and plants, such as ferns (not shown).

Referring now to FIGS. 1 and 2, the artificial frond 10 includes a central elongate stem portion 12 and a plurality of elongate leaves 14 extending outwardly from the stem portion 12 in a fan-like arrangement. The entire artificial frond 10 is formed in one piece as an integral sheet 16 of flexible polymeric material.

As shown in FIG. 2, the integral sheet 16 is a laminated material composed of an intermediate body layer 18 of flexible polymeric material sandwiched between two outer surface layers 20 and 22 of flexible polymeric material. The intermediate body layer 18 is preferably a flexible polymeric foam, such as flexible polyurethane foam. Other flexible polymeric foams that could be used include flexible polyester foam and flexible polystyrene foam. The two outer surface layers 20 and 22 can be formed of any flexible polymer-based protective coating, such as an acrylic or acrylic/aliphatic urethane coating, pigmented to simulate the color of a natural palm frond.

In order to provide the artificial frond 10 with sufficient tear resistance, particularly in the thinner sectioned leaf portion thereof, the integral sheet 16 is preferably reinforced with an elasticity-imparting fiber material embedded within the intermediate body layer 18. As shown in FIG. 2, the fiber reinforcement preferably takes the form of a fiber cloth layer 24 sandwiched within the polymeric material of the intermediate body layer 18. The fiber cloth layer 24 is preferably composed of spandex or other polyurethane fibers. Alternatively, the fiber cloth layer 24 may be replaced with chopped polymeric fibers, such as polyurethane or polypropylene fibers, dispersed within the matrix of the polymeric material of the intermediate body layer 18.

In order to provide the artificial frond 10 with sufficient structural support, the integral sheet 16 is further reinforced by having embedded within the intermediate body layer 18 a central elongate supporting rod 26 extending longitudinally through the stem portion 12 of the artificial frond 10 and into the opposite leaf 14*a*. Auxiliary elongate supporting rods 28, 30, 32 and 34, also embedded within the intermediate body layer 18, extend outwardly from the central supporting rod 26 into leaves 14*b*, 14*c*, 14*d* and 14*e*, respectively. The supporting rods 26, 28, 30, 32 and 34 are preferably constructed of a high strength lightweight metallic material, such as steel. The supporting rods could alternatively be constructed of other materials, including other metals or polymers.

The artificial frond 10 in accordance with the present invention, can be easily molded in one piece by standard molding techniques well known in the art. For fabricating a mold suitable for use in producing artificial fronds authentic in appearance, it is preferred to start with a live frond and build up a resinous mold based on the live frond. By way of example, the live frond is first bedded in plasticine clay and then sprayed with a barrier coating such as polyvinyl alcohol to facilitate release of the frond from the finished mold. The resin to be used for the mold body is then applied over the coated frond. Such resin may be, for example, an epoxy resin or a polyester resin suitable for spray application in sufficient thickness. Because of the hard angles and deep draws of the frond, it will usually be necessary to apply over the cured resin a back up coating of the same resin with body filler which can be brushed on to smooth out irregularities, round out the contours and soften the surface. Fiberglass matt is then laid on top of the softened surface and saturated with a laminating resin to reinforce the mold body to a thickness of ⅜ to ½ inch. After the laminating resin has cured, 2×2×3/16 inch steel angles are placed every 6 inches across the mold and glassed in place with additional laminating resin. This strengthens the mold, helps distribute the clamping pressure, and levels off the back surfaces of the mold. The thus formed first half of the mold is then turned over, the live frond removed and discarded, and the mating surfaces cleaned of clay.

In fabricating the second half of the mold, provision is made for the supporting rods used in the molded artificial frond by jigging the interior of the second mold half to accommodate such rods. This is accomplished by positioning such rods in the interior of the first mold half, covering the rods with plasticine clay, and sculpting the clay to resemble the appearance of a natural frond. A barrier coating such as polyvinyl alcohol is then sprayed over the sculpted clay, and the second half of the mold built up as with the first half. The mold halves are then dismantled and cleaned.

The thus fabricated mold may then be used for casting the artificial frond 10. The interior surfaces of the mold halves are first prepared by application of a wax sealer and mold release agent for easy release of the finished casting from the mold. The pigmented flexible polymer-based protective coating forming the two outer surface layers 20 and 22 of the finished artificial frond 10, is then applied over the interior surface of each mold half. This protective coating also serves as a barrier coat to help protect the mold surfaces from the action of the polyurethane solvents used in forming the intermediate body layer 18. The fiber cloth layer 24 is then placed within the jigged mold half, and the supporting rods 26, 28, 30, 32 and 34 laid over the fiber cloth. The components of the flexible polyurethane foam forming the intermediate body layer 18 are then mixed and poured into the mold over the supporting rods and fiber cloth. The other half of the mold is placed over the first half and clamped into position. A hydraulic press is then used to guarantee full compression of the mold halves. After the foam-forming process has been completed, the cast is de-molded and the flashing trimmed with a sharp knife. The cast should be laid flat for at least 24 hours to fully cure. Touch-up painting of the artificial frond surface can be done anytime after the cast is trimmed.

The resulting artificial frond 10 closely resembles its natural counterpart in appearance. Furthermore, the reinforcement provided by the supporting rods 26, 28, 30, 32 and 34, and the fiber cloth layer 24, is sufficient to maintain the structural integrity of the artificial frond.

The foregoing description describes the present invention in its preferred embodiment. It will be appreciated by those skilled in the art that changes could be made to the embodiment described above without departing from the broad inventive concept thereof. It is understood, therefore, that this invention is not limited to the particular embodiment disclosed, but it is intended to cove all modifications and artificial plants which are within the scope and spirit of the invention, as defined by the appended claims.

What is claimed is:

1. An artificial frond for use with artificial plants, said artificial frond comprising an integral sheet of flexible polymeric material having at least one reinforcing means embedded therein, said polymeric material comprising a flexible polymeric foam, said integral sheet being formed generally in the shape of a frond having a central elongate stem portion and a plurality of elongate leaves extending outwardly from said stem portion, said reinforcing means being sufficient to maintain the structural integrity of said artificial frond.

2. The artificial frond of claim 1, wherein said polymeric material comprises a flexible polyurethane foam.

3. The artificial frond of claim 1, wherein said reinforcing means comprises an elasticity-imparting fiber material.

4. The artificial frond of claim 3, wherein said fiber material is a polymeric fiber.

5. The artificial frond of claim 4, wherein said polymeric fiber is a polyurethane fiber.

6. The artificial frond of claim 3, wherein said reinforcing means comprises a fiber cloth layer sandwiched within said integral sheet.

7. The artificial frond of claim 6, wherein said fiber cloth is composed of spandex fibers.

8. The artificial frond of claim 1, wherein said reinforcing means comprises at least one elongate supporting rod providing structural support for said artificial frond.

9. The artificial frond of claim 8, wherein said reinforcing means comprises a central elongate supporting rod extending longitudinally through said stem portion of said artificial frond.

10. The artificial frond of claim 9, wherein said reinforcing means further includes a plurality of auxiliary elongate supporting rods extending outwardly from said central supporting rod into said leaves of said artificial frond.

11. The artificial frond of claim 1, wherein said integral sheet is a laminate comprising an intermediate body layer of flexible polymeric foam having said at least one reinforcing means embedded therein, said intermediate body layer being sandwiched between two outer surface layers of flexible polymeric material pigmented to simulate the color of a natural frond.

12. The artificial frond of claim 11, wherein said intermediate body layer has an elasticity-imparting polymeric fiber material embedded therein.

13. The artificial frond of claim 12, wherein said foam is a flexible polyurethane foam, and said fiber material is a spandex fiber cloth layer sandwiched within said foam.

14. An artificial frond for use with artificial plants, said artificial frond comprising an integral sheet of flexible polymeric material formed generally in the shape of a frond having a central elongate stem portion and a plurality of elongate leaves extending outwardly from said stem portion in a fan-like arrangement, said integral sheet having reinforcing means embedded therein for providing structural support for said artificial frond, said reinforcing means comprising a central elongate supporting rod extending longitudinally through said stem portion and into one of said leaves of said artificial frond, and a plurality of auxiliary elongate supporting rods extending outwardly from said central supporting rod into a plurality of other leaves of said artificial frond.

15. The artificial frond of claim 14, wherein said integral sheet is a laminate comprising an intermediate body layer of flexible polymeric material having said reinforcing means embedded therein, said intermediate body layer being sandwiched between two outer surface layers of flexible polymeric material pigmented to simulate the color of a natural frond.

16. The artificial frond of claim 15, wherein said intermediate body layer is formed of a flexible polymeric foam having an elasticity-imparting polymeric fiber material embedded therein.

17. The artificial frond of claim 16, wherein said foam is a flexible polyurethane foam, and said fiber material is a spandex fiber cloth layer sandwiched within said foam.

18. An artificial frond for use with artificial plants, said artificial frond comprising an integral sheet of flexible polymeric material having at least one reinforcing means embedded therein, said integral sheet being formed generally in the shape of a frond having a central elongate stem portion and a plurality of elongate leaves extending outwardly from said stem portion, said reinforcing means being sufficient to maintain the structural integrity of said artificial frond, said reinforcing means comprising an elasticity-imparting fiber material.

19. The artificial frond of claim 18, wherein said fiber material is a polymeric fiber.

20. The artificial frond of claim 19, wherein said polymeric fiber is a polyurethane fiber.

21. The artificial frond of claim 18, wherein said reinforcing means comprises a fiber cloth layer sandwiched within said integral sheet.

22. The artificial frond of claim 21, wherein said fiber cloth is composed of spandex fibers.

23. The artificial frond of claim 18, wherein said reinforcing means comprises at least one elongate supporting rod providing structural support for said artificial frond.

24. The artificial frond of claim 23, wherein said reinforcing means comprises a central elongate supporting rod extending longitudinally through said stem portion of said artificial frond.

25. The artificial frond of claim 24, wherein said reinforcing means further includes a plurality of auxiliary elongate supporting rods extending outwardly from said central supporting rod into said leaves of said artificial frond.

26. The artificial frond of claim 18, wherein said integral sheet is a laminate comprising an intermediate body layer of flexible polymeric material having said at least one reinforcing means embedded therein, said intermediate body layer being sandwiched between two outer surface layers of flexible polymeric material pigmented to simulate the color of a natural frond.

27. The artificial frond of claim 26, wherein said reinforcing means comprises a fiber cloth layer sandwiched within said integral sheet.

28. The artificial frond of claim 27, wherein said fiber cloth is composed of spandex fibers.

* * * * *